US010940971B2

(12) United States Patent
Young et al.

(10) Patent No.: US 10,940,971 B2
(45) Date of Patent: Mar. 9, 2021

(54) PACKAGING FOR AN ATTACHABLE UNIT FOR A SMOKING ARTICLE

(71) Applicant: British American Tobacco (Investments) Limited, London (GB)

(72) Inventors: Richard Young, London (GB); Paul Hodges, London (GB); Karl Kaljura, London (GB); Benjamin Taylor, London (GB); Darren Hubbert, London (GB); Victoria Brown, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 16/306,757

(22) PCT Filed: Jun. 8, 2017

(86) PCT No.: PCT/GB2017/051676
§ 371 (c)(1),
(2) Date: Dec. 3, 2018

(87) PCT Pub. No.: WO2017/212285
PCT Pub. Date: Dec. 14, 2017

(65) Prior Publication Data

US 2019/0127110 A1 May 2, 2019

(30) Foreign Application Priority Data

Jun. 9, 2016 (GB) ..... 1610103
Nov. 23, 2016 (GB) ..... 1619815

(51) Int. Cl.
*B65D 5/38* (2006.01)
*B65D 5/50* (2006.01)
(Continued)

(52) U.S. Cl.
CPC ..... *B65D 5/38* (2013.01); *A24F 47/00* (2013.01); *B65D 5/5038* (2013.01); *B65D 85/08* (2013.01)

(58) Field of Classification Search
CPC ..... A24F 15/14; A24F 47/00; B65D 5/38; B65D 5/50; B65D 5/5038; B65D 5/538; B65D 59/04; B65D 85/08
(Continued)

(56) References Cited

U.S. PATENT DOCUMENTS 1,812,311 A 5/1928 Wolf
3,228,518 A 1/1966 Coby
(Continued)

FOREIGN PATENT DOCUMENTS

CN 204568208 U 8/2015
EP 2954792 A1 12/2015
(Continued)

OTHER PUBLICATIONS

International Preliminary Report on Patentability for corresponding application PCT/GB2017/051676 filed Jun. 8, 2017; Report dated Dec. 20, 2018.
(Continued)

*Primary Examiner* — Bryon P Gehman
(74) *Attorney, Agent, or Firm* — Cantor Colburn LLP

(57) ABSTRACT

Packaging for an attachable unit for a smoking article The invention relates to packaging (300) for an attachable unit (3) for a smoking article (2) comprising a receiver (301) to receive an attachable unit and a guide (306) for aligning the smoking article with the attachable unit when the attachable unit is received by the receiver such that the attachable unit can be attached to the smoking article. The invention also relates to packaging for an attachable unit for a smoking article comprising a receptacle or receiver in which the
(Continued)

attachable unit is receivable and a gripping mechanism (307) to releasably hold the attachable unit within the receptacle or receiver when the attachable unit is received in the receptacle or receiver.

17 Claims, 9 Drawing Sheets

(51) Int. Cl.
*A24F 47/00* (2020.01)
*B65D 85/08* (2006.01)

(58) Field of Classification Search
USPC ..... 206/562, 563; 229/125.125
See application file for complete search history.

(56) References Cited

U.S. PATENT DOCUMENTS

| | | | | |
|---|---|---|---|---|
| 3,360,123 | A | 12/1967 | Oswalt | |
| 3,375,920 | A * | 4/1968 | Shaw | A24D 3/048 206/469 |
| 3,664,569 | A * | 5/1972 | Dock | B65D 5/38 206/256 |
| 5,148,918 | A | 9/1992 | Weder | |
| 7,854,325 | B2 * | 12/2010 | Bentele | B65D 5/38 206/1.5 |
| 8,100,134 | B2 * | 1/2012 | Meyer | A24D 3/043 131/330 |
| 8,517,250 | B2 * | 8/2013 | Philips | B65D 5/38 229/125.125 |
| 9,371,151 | B2 * | 6/2016 | Nadeau | B65D 5/5213 |
| 9,801,412 | B2 * | 10/2017 | Grant | A24D 1/04 |
| 9,826,778 | B2 * | 11/2017 | Simpson | B65D 83/02 |
| 9,981,788 | B2 * | 5/2018 | Skinner | B65D 5/38 |
| 10,034,493 | B2 * | 7/2018 | Akiyama | B65D 85/1081 |

FOREIGN PATENT DOCUMENTS

| | | | |
|---|---|---|---|
| FR | 2583020 | A1 | 6/1985 |
| GB | 1572073 | | 7/1980 |
| JP | S48017273 | U | 2/1973 |
| JP | S5512494 | U | 1/1980 |
| JP | H01177118 | U | 12/1989 |
| JP | H05508373 | A | 11/1993 |
| JP | 3111514 | U | 6/2005 |
| WO | 2012171636 | A1 | 12/2012 |
| WO | 2014136721 | A1 | 9/2014 |

OTHER PUBLICATIONS

International Search Report for corresponding application PCT/GB2017/051676 filed Jun. 8, 2017; dated Sep. 19, 2017.

Written Opinion for corresponding application PCT/GB2017/051676 filed Jun. 8, 2017; dated Sep. 19, 2017.

JP Notice of Reasons for Refusal dated Dec. 18, 2019 re: Application No. 2018-564400, pp. 1-7, citing: WO 2014/136721 A1, JP H1-177118 U, JP S55-012494 U, JP 3111514 U, U.S. Pat. No. 1,812,311 and JP H05-508373 A.

JP Office Action dated Sep. 23, 2020, re Application No. 2018-564400, pp. 1-5, citing: WO 2014/136721, JP S48-017273 and JP H05-508373.

* cited by examiner

PACKAGING FOR AN ATTACHABLE UNIT FOR A SMOKING ARTICLE

TECHNICAL FIELD

The invention relates to packaging for an attachable unit for a smoking article, an arrangement of one or more blanks for forming the same, and a kit including said packaging and a plurality of smoking article rods.

BACKGROUND

Cigarettes and other smoking articles produce an aerosol, smoke in the case of cigarettes, which is inhaled by a user. Separate filter units may be attached to smoking articles to modify the aerosol before it reaches the user's mouth.

SUMMARY

According to embodiments of the invention, there is provided packaging for an attachable unit for a smoking article comprising a receptacle or receiver in which the attachable unit is receivable and a gripping mechanism to releasably hold the attachable unit within the receptacle or receiver when the attachable unit is received in the receptacle or receiver.

The packaging can further comprise a sleeve portion and a tray slidable within the sleeve portion, wherein the tray comprises the gripping mechanism and the receptacle or receiver.

The receptacle or receiver can comprise a receiving aperture which is at least partially defined by a recess or cut-out formed in an upper panel of the tray.

The upper panel can be arranged to be disposed parallel to a base panel of the tray when the attachable unit is received in the receptacle or receiver.

The upper panel can be arranged to be disposed nonparallel to a base panel of the tray the attachable unit is received in the receptacle or receiver.

The tray can comprise a plurality of side panels. The gripping mechanism can comprise at least one of the side panels. Said at least one side panel can be at least partially resiliently displaceable to provide a biasing force, in use, on an attachable unit when received in the receptacle or receiver.

At least a portion of each of the side panels can have a height which is less than a height of a side panel of the sleeve portion.

The sleeve portion can comprise an upper panel, and the tray can further comprise a base panel and a guide member configured to provide a reactive force against the sleeve portion to keep the base panel of the tray substantially parallel to the upper panel of the sleeve as the tray is slid within the sleeve portion.

The receptacle or receiver can comprise a receiving aperture and the gripping mechanism can comprise a tab that depends from an edge of the receiving aperture for engagement with an attachable unit received therein. The tab can be at least partially resiliently displaceable. The tab can be formed from material forming a panel in which the receptacle is formed. The tab can be formed from material within the periphery of the receiving aperture. The packaging can comprise between one and six tabs for each receiving aperture, or can comprise 4 tabs for each receiving aperture.

The gripping mechanism can comprise an adhesive.

According to embodiments of the invention, there is further provided packaging for an attachable unit for a smoking article comprising a receiver to receive the attachable unit in a predetermined position and a guide disposed relative to the receiver to align the smoking article with the attachable unit when the attachable unit is received by the receiver such that the attachable unit can be attached to the smoking article.

The receiver can be formed in a first sheet material lying in a first plane and the guide can be formed in a second sheet material lying in a second plane spaced from said first plane.

The first plane can be parallel to the second plane.

The receiver and guide can be circular apertures centred on a common axis. The common axis can be perpendicular to the first and/or second planes.

The second plane can be spaced from said first plane by a distance of between 5 mm and 50 mm or between 10 mm and 25 mm or between 15 mm and 20 mm.

The packaging can comprise an outer container comprising a first panel in which the guide is formed.

The packaging can comprise an inner panel held within the outer container, wherein the receiver is formed in the inner panel.

The outer container can comprise a second panel spaced from said first panel and the inner panel can be provided between the first and second panels and can be spaced a predetermined distance from the first and second panels. The predetermined distance of the inner panel from the first panel can be between 5 mm and 30 mm and the predetermined distance of the inner panel from the second panel can be between 3 mm and 15 mm.

The packaging can further comprise a sleeve, wherein the outer container is slideably received in the sleeve to provide access to the receiver and guide.

The packaging can further comprise a plurality of receivers, wherein the receiver comprises one of the plurality of receivers.

The packaging can further comprise a plurality of guides, wherein the guide comprises one of the plurality of guides, and wherein each respective guide is arranged to align the smoking article with a respective attachable unit when the respective attachable unit is received by a respective receiver such that the respective attachable unit can be attached to the smoking article.

The plurality of guides and the plurality of receivers can each be provided in a respective array.

The packaging can comprise an adhesive patch applied to an outer surface of the packaging to enable the packaging to be attached to an object or surface.

The or each receiver can comprise a receptacle, and the packaging can further comprise a gripping mechanism associated with the or each receptacle to releasably hold an attachable unit within the or each receptacle.

The or each receptacle can comprise a receiving aperture and the gripping mechanism can comprise a tab that depends from an edge of the or each receiving aperture for engagement with an attachable unit received therein.

The tab can be at least partially resiliently displaceable. The tab can be formed from material forming a or the panel in which the receiving aperture is formed. The tab can be formed from material within the periphery of the receiving aperture.

The packaging can comprise between one and six tabs for each receiving aperture, or can comprise 4 tabs for each receiving aperture.

The gripping mechanism can comprises an adhesive.

The packaging can further comprise a resealable cover flap that extends over the or each guide.

The guide can comprise an inner edge of an aligning aperture formed in the packaging.

According to embodiments of the invention, there is further provided an arrangement of one or more blanks for forming packaging according to embodiments of the invention as set out above.

According to embodiments of the invention, there is further provided packaging according to embodiments of the invention as set out above comprising an attachable unit for a smoking article received within the or each receiver, the attachable unit to be attached to a smoking article rod by a user to modify an aerosol generated by the smoking article rod.

According to embodiments of the invention, there is further provided a kit comprising packaging according to embodiments of the invention as set out above, and a plurality of smoking article rods.

DETAILED DESCRIPTION

Figure 1:
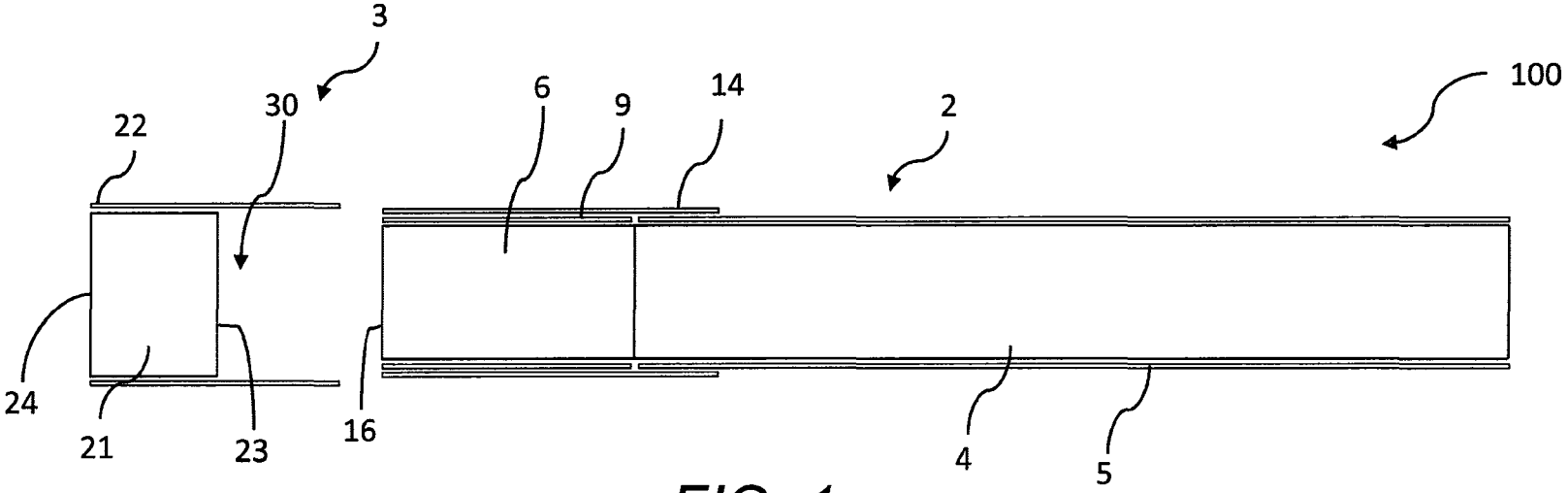
FIG. 1 illustrates an example of a smoking article rod and an attachable unit arranged to be coupled to the smoking article rod.

As used herein, the term "smoking article" includes combustible smoking articles such as cigarettes, cigars and cigarillos whether based on tobacco, tobacco derivatives, expanded tobacco, reconstituted tobacco or tobacco substitutes and also heating devices such as heat-not-burn (HnB) devices, which release compounds from substrate materials, such as tobacco, without burning the substrate material, and other nicotine delivery products such as aerosol generation devices including e-cigarettes. The smoking article may be provided with a filter for the gaseous flow drawn by the smoker. Smoking articles such as cigarettes and their formats are often named according to the cigarette length: "regular" (typically in the range 68-75 mm, e.g. from about 68 mm to about 72 mm), "short" or "mini" (68 mm or less), "king-size" (typically in the range 75-91 mm, e.g. from about 79 mm to about 88 mm), "long" or "super-king" (typically in the range 91-105 mm, e.g. from about 94 mm to about 101 mm) and "ultra-long" (typically in the range from about 110 mm to about 121 mm).

They are also named according to the cigarette circumference: "regular" (about 23-25 mm), "wide" (greater than 25 mm), "slim" (about 22-23 mm), "demi-slim" (about 19-22 mm), "super-slim" (about 16-19 mm), and "micro-slim" (less than about 16 mm). Accordingly, a cigarette in a king-size, super-slim format will, for example, have a length of about 83 mm and a circumference of about 17 mm. Cigarettes in the regular, king-size format are preferred by many customers, namely with a circumference of from 23 to 25 mm and an overall length of from 75 to 91 mm.

Each format may be produced with filters of different lengths, smaller filters being generally used in formats of smaller lengths and circumferences. Typically the filter length will be from about 15 mm, associated with short, regular formats, to 30 mm, associated with ultra-long super-slim formats. The tipping paper will have a greater length than the filter, for example from 3 to 10 mm longer, such that the tipping paper covers the filter and overlaps the tobacco rod to connect the filter to the tobacco rod.

Smoking articles described herein can be made in, but are not limited to, any of the above formats.

In the figures described herein, like reference numerals are used to illustrate equivalent features, articles or components.

FIG. 1 is a side-on cross sectional view of a first example of an attachable unit 3 and a smoking article rod 2 which can be coupled together by a user to form a smoking article 100. The attachable unit 3 is configured to modify one or more properties of an aerosol generated by the smoking article rod 2.

The attachable unit 3 comprises a recess 30 into which at least a portion of the smoking article rod 2 can be received when the attachable unit 3 is coupled to the smoking article rod 2. In the present example, the attachable unit 3 comprises a cylindrical element 21 which is surrounded by a sheet material 22 forming a sleeve around the cylindrical element 21. In the present example, the cylindrical element 21 comprises filter material, in the present case cellulose acetate tow, circumferentially wrapped in the sheet material 22, although the attachable unit 3 can be formed in other ways. In the present case, the sheet material 22 comprises stiff paper.

The attachable unit is arranged such that the smoking article rod 2 and attachable unit 3 are aligned on a longitudinal axis when the attachable unit 3 is coupled to the smoking article rod 2.

The cylindrical element 21 comprises first and second longitudinal ends 23, 24, which, in the present example are exposed, allowing smoke or other aerosols to pass longitudinally through the cylindrical element 21. As illustrated, to form the recess 30, the sheet material 22 extends longitudinally beyond the first longitudinal end surface 23 of the cylindrical element 21. The recess 30 is formed by the first longitudinal end surface 23 of the cylindrical element 21 together with the inner surface of the portion of the sheet material 22 which extends longitudinally beyond the first longitudinal end surface 23 of the cylindrical element 21. The sheet material 22 extends up to the second longitudinal end surface 24 of the cylindrical element 21, although can alternatively extend beyond the second longitudinal end surface 24, forming a further recess (not shown), or can be arranged to stop short of the longitudinal end surface 24, such that the sheet material 22 does not surround the full length of the cylindrical element 21.

The smoking article rod 2 shown in FIG. 1 has a tobacco rod 4 longitudinally connected, end-on, to a filter 6. An external end surface 16 of the filter 6 at the end opposite to the end of the filter 6 facing the tobacco rod 4 defines a mouth end surface 16 of the smoking article rod 2. The smoking article rod 2 can be a conventional smoking article, such as a cigarette. In the present example, the tobacco rod 4 is wrapped in a wrapping material 5, in this case cigarette paper. The filter 6 is, in the present example, formed from cellulose acetate tow wrapped in a plug wrap 9. The tobacco rod 4 and filter 6 are connected by a tipping material 14 overlaying the filter 6 and partially overlaying the wrapping material 5. The filter 6 may comprise two or more filter sections forming the filter 6, which can be connected together using a further plug wrap (not shown), prior to connection of the filter 6 to the tobacco rod 4 using the tipping material 14.

In use, the smoking article 100 can be provided to users with the attachable unit 3 and smoking article rod 2 as separate components, for instance packaged separately. Prior to a user first using the smoking article rod 2, the attachable unit 3 can be attached to the smoking article rod 2 by inserting the mouth-end 16 of the smoking article rod 2 into the recess 30 of the attachable unit 3. When the attachable unit 3 is coupled to the smoking article rod 2, the first longitudinal end surface 23 of the cylindrical element 21 abuts the mouth end surface 16 of the filter 6 of the smoking article rod 2.

The user can select whether or not to attach the attachable unit 3 to the smoking article rod 2 prior to smoking the smoking article 100, and can in this way control the length of filter of the smoking article 100 and therefore the level of filtration of the aerosol generated by the smoking article rod 2. The attachable unit 3 can also include additives for modifying the aerosol, in the present case smoke, generated by the smoking article rod 2. For instance, in the present example, a capsule containing a flavour additive (not shown) is located within the cylindrical element 21. The capsule has a liquid centre and a frangible outer shell which can be broken by a user by squeezing the attachable unit 3, to thereby release the flavour additive. The flavour additive is transferred to the aerosol generated by the smoking article rod 2 as the smoking article 100 is smoked. In alternative examples, the attachable unit 3 may include alternative additives for modifying the aerosol generated by the smoking article rod 2, such as granules of activated carbon or other adsorbents, humectants, diluents and suchlike.

Figure 2:
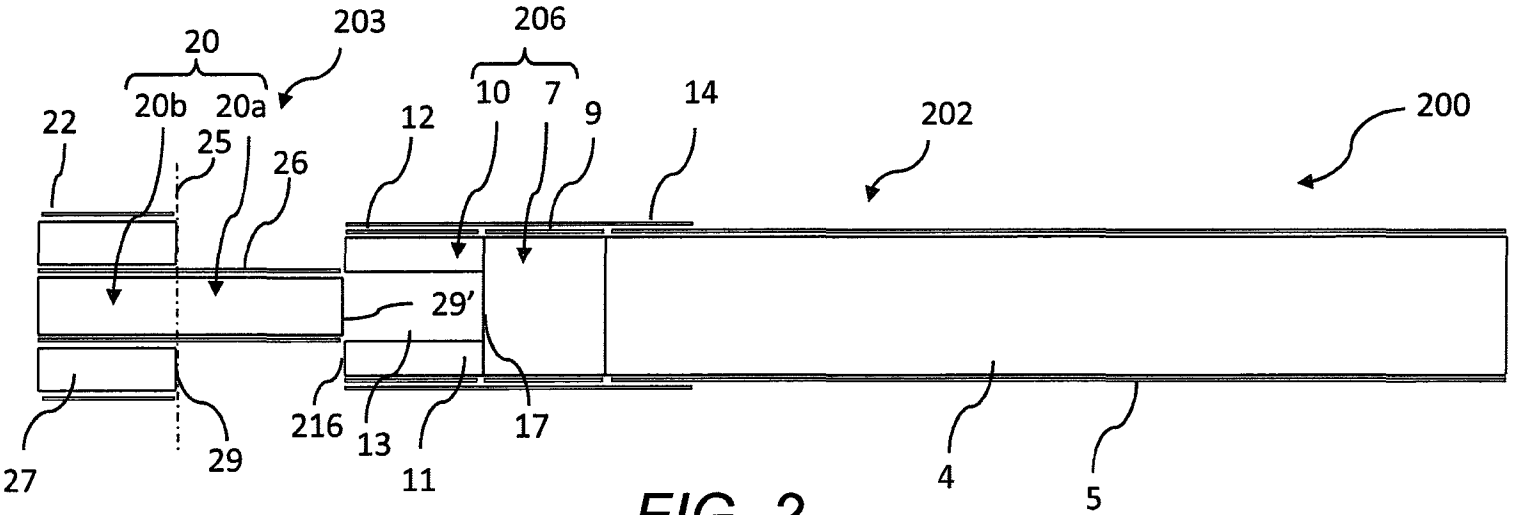
FIG. 2 illustrates a further example of a smoking article rod and an attachable unit arranged to be coupled to the smoking article rod.

FIG. 2 is a side-on cross sectional view of a second example of an attachable unit 203 and a smoking article rod 202 which can be coupled to form a smoking article 200.

Referring to FIG. 2, the attachable unit 203 is arranged to be coupled to the smoking article rod 202 by a user. The smoking article rod 202 in the present example comprises a first recess 13. As with the attachable unit 3 of the example of FIG. 1, the attachable unit 203 is configured to modify one or more properties of an aerosol generated by the smoking article rod 202. The attachable unit 203 includes an element 20 arranged to be inserted at least partially into the first recess 13 of the smoking article rod 202.

In the present example, the smoking article rod 202 is a cigarette and includes a tobacco rod 4 wrapped in a wrapping material 5, in this case cigarette paper. The smoking article rod 202 includes a filter 206 at its mouth end comprising a first section 7 located at the tobacco rod end of the filter 206. The first filter section 7 is, in the present example, formed from cellulose acetate tow wrapped in a first plug wrap 9. The filter 6 also includes a second section 10 located downstream of the first section 7 and comprising a tubular element 11 wrapped in a second plug wrap 12.

The tubular element 11 is, in the present example, open at the mouth end of the smoking article rod 202 and defines the first recess, or cavity, 13 at that end. A mouth end surface 216 of the tubular element 11 is exposed at the mouth end of the smoking article rod 202. The tobacco rod 4 and first and second filter sections 7, 10 are connected by a tipping material 14 overlaying the first and second filter sections 7, 10 and partially overlaying the wrapping material 5. The first and second filter sections 7, 10, and any other sections forming the filter 206, can be connected together using a further plug wrap (not shown), prior to connection of the filter 206 to the tobacco rod 4 using the tipping material 14.

The cylindrical element 20 of the attachable unit 203 is wrapped in a plug wrap 26 which is substantially impermeable to air, for instance having a permeability of greater than 50 Coresta Units or greater than 100 Coresta Units. However, the cylindrical element 20 may alternatively be unwrapped.

The cylindrical element 20 of the attachable unit 203 has adjacent first and second portions 20*a*, 20*b*, each extending partially along the length of the cylindrical element 20. In the present example, the first portion 20*a* of the cylindrical element 20 extends from an insertion end of the cylindrical element 20 to an intermediate position 25 along the length of the cylindrical element 20. In the present example, the second portion 20*b* of the cylindrical element 20 extends from a mouth end of the cylindrical element 20 and ends at the intermediate position 25 along the length of the cylindrical element 20.

In the present example, the cylindrical element 20 is 25 mm in length and the intermediate position 25 is 12.5 mm along the length of the cylindrical element 20 from the insertion end. The first portion 20*a* of the cylindrical element 20 is arranged to be inserted, by a user, into the recess 13 at the mouth end of the smoking article rod 302.

The attachable unit 203 further comprises an annular element 27 which is arranged around the periphery of the second portion 20*b* of the cylindrical element 20. The annular element 27 has a larger external diameter than the internal diameter of the recess 13.

The longitudinal end surface 29 of the annular element 27 is arranged to face the smoking article rod 202 when the attachable unit 203 is coupled to the smoking article rod 202. The longitudinal end surface 29 may abut the mouth end surface 216 of the tubular element 11 when the attachable unit 203 is attached to the smoking article rod 202, as described below. Additionally or alternatively, a longitudinal end surface 29' of the cylindrical element 20 may abut a mouth end surface 17 of the first filter section 7 when the attachable unit 203 is attached to the smoking article rod 202.

The first portion 20*a* of the cylindrical element 20 is arranged to be inserted into the first recess 13 in the smoking article rod 202, in the present case into the recess 13 formed by the tube section 11. The internal diameter and/or length of the recess 13 and the external diameter and/or length of the first portion 20*a* of the cylindrical element 20 are arranged to substantially correspond such that the first portion 20*a* of the cylindrical element 20 can be received within and substantially fill the recess 13. For instance, the internal diameter of the recess 13 can be substantially the same as the external diameter of the first portion 20*a* of the cylindrical element 20. Furthermore, the length of the recess 13 can be substantially the same as the length of the first portion 20*a* of the cylindrical element 20 protruding proud of the annular element 27.

In practice, the correspondence between the dimensions of the recess 13 and those of the first portion 20*a* of the cylindrical element 20 will depend on the materials used to form these components and the desired closeness of the fit between them. It is likely to be preferable that the recess dimensions are slightly larger than the dimensions of the first portion 20*a*, to facilitate insertion of the cylindrical element 20 into the recess 13.

In the example of FIG. 2, the recess 13 has an internal diameter of 4 mm and the cylindrical element 20 has an external diameter of 3.8 mm. In alternative examples, the internal diameter of the recess 13 and external diameter of the cylindrical element 20 can have other values, for instance diameters in the range from 2 mm to 6 mm. In the example of FIG. 2, the recess 13 has an internal length of 12 mm and the first portion 20*a* of the cylindrical element 20 has a length of 12 mm. In alternative examples, the internal length of the recess 13 and the length of the first portion 20*a* of the cylindrical element 20 can have other values, for instance values in the range from 5 mm to 20 mm.

In the present example, the annular element 27 is attached to the cylindrical element 20 using an adhesive (not shown). The annular element 27 may be attached to the cylindrical element 20 by means other than an adhesive, for example by mechanical means such as a friction fit or other locking arrangement.

The attachable unit 203 can include additives for modifying the aerosol, in the present case smoke, generated by the smoking article rod 202, in the same way as the attachable unit 3 described with reference to FIG. 1 above.

In use, the smoking article 200 can be provided to users with the attachable unit 203 and smoking article rod 202 as separate components. Prior to a user first using the smoking article rod 202, the attachable unit 203 can be attached to the smoking article rod 202 by inserting the first portion 20*a* of the cylindrical element 20 into the recess 13. When the attachable member 203 is coupled to the smoking article rod 202, the longitudinal end surface 29 of the annular element 27 may abut the end surface 216 of the tubular element 11.

The user can select whether or not to attach the attachable unit 203 to the smoking article rod 202 prior to smoking the smoking article 200, and can in this way control the length of filter of the smoking article 200 and therefore the level of filtration of the aerosol generated by the smoking article 200, as well as other properties of the aerosol in the case that the attachable unit 203 includes one or more additives for modifying the aerosol.

Figure 3:
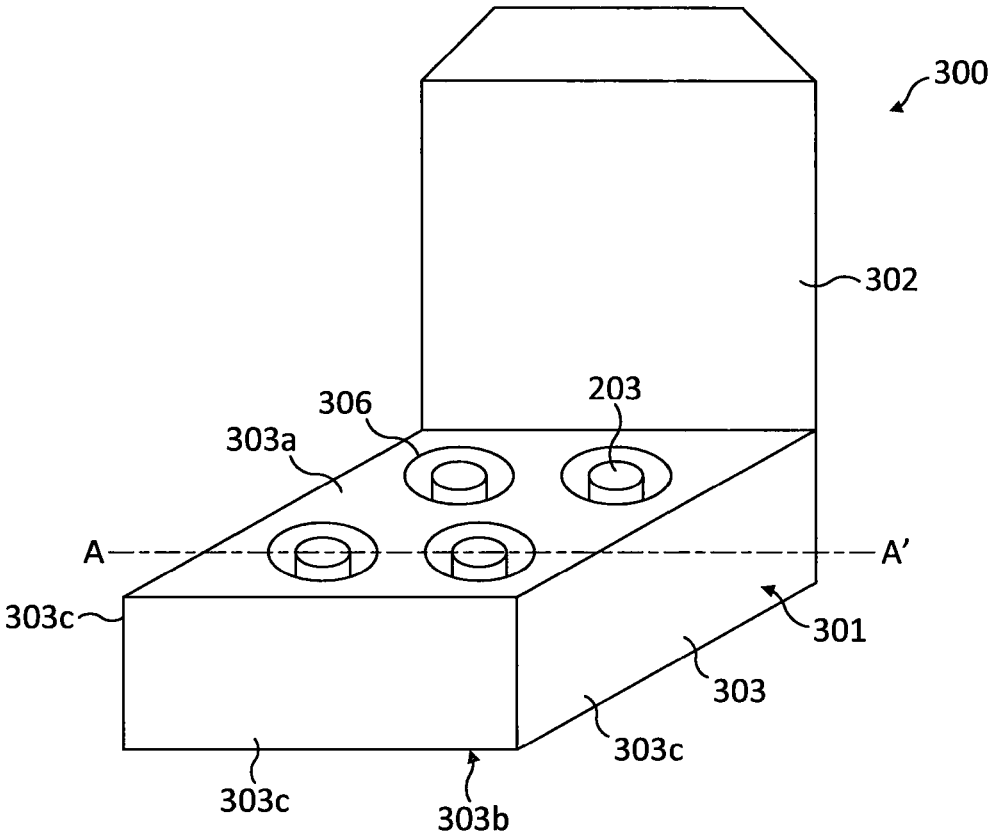
FIG. 3 is a perspective illustration of packaging for attachable units for smoking articles according to a first example.
Figure 4:
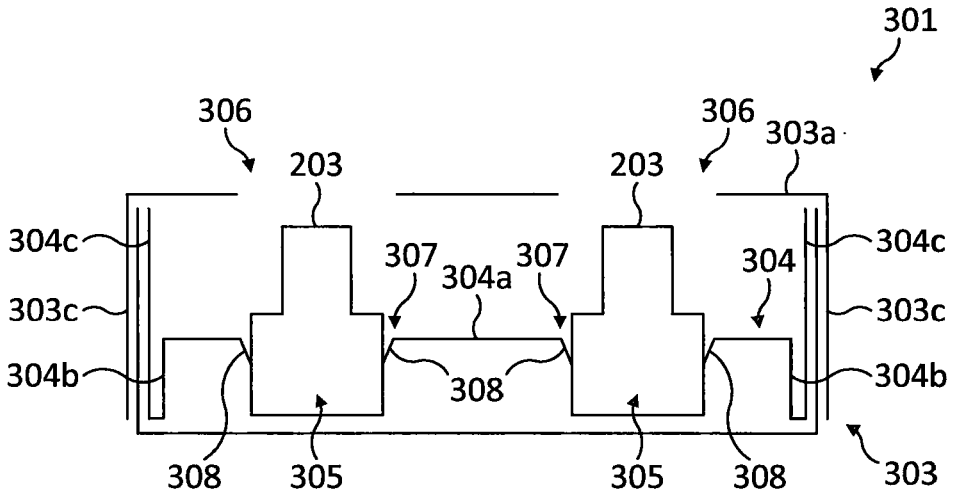
FIG. 4 is a cross sectional view of the packaging illustrated in FIG. 3, through the line A-A' thereof.

FIG. 3 is a perspective illustration of packaging 300 for attachable units for smoking articles according to a first example. The packaging 300 is configured to receive attachable units 3, 203 of the first or second attachable unit examples described with reference to FIGS. 1 and 2, or other such attachable units for smoking articles. FIG. 4 is a cross sectional view of the packaging illustrated in FIG. 3, through the line A-A' thereof.

The packaging 300 includes a body portion 301 and a lid portion 302 hingedly connected to the body portion 301. In the present example, the body portion 301 is substantially cuboid in shape. As illustrated in FIG. 4, the body portion 301 includes an outer container 303 and a body portion insert 304. The outer container 303 comprises a first panel 303*a*, a second panel 303*b*, and side panels 303*c* extending between the first and second panels 303*a*, 303*b*. The body portion insert 304 includes receivers 305, in the present example receiving apertures 305, in which attachable units as described herein are receivable. Other forms of receptacle for attachable units can be used. The receiving apertures are also referred to as retaining or holding apertures. In alternative examples, the receivers need not be formed as the receptacles or receiving apertures described herein, but could comprise an adhesive applied to a panel or other supporting arrangement for receiving attachable units. In the present example, the receiving apertures 305 are illustrated having the attachable units 203 of the second attachable unit example received therein.

The body portion 301 also includes guides 306, in the present case aligning apertures 306, also referred to as guiding apertures. In the present example, the aligning apertures 306 are provided in the first panel 303*a* of the outer container 303. An inner edge of the guiding aperture is used to align a smoking article rod with a receiver, receptacle or receiving aperture, as will be described in more detail below.

The aligning apertures 306 are each aligned with a respective receiving aperture 305, and accordingly with a respective attachable unit received in the receiving aperture, so that, when an attachable unit 3, 203 is received in a receiving aperture 305 and a smoking article rod is inserted through a corresponding alignment aperture 306, the smoking article rod is aligned with the attachable unit 3, 203 prior to attachment of the attachable unit 3, 203 to the smoking article rod. This facilitates attachment of the attachable unit 3, 203 to the smoking article rod, while protecting the attachable units 3, 203 within the body portion 301. The aligning apertures 306 accordingly have a size and shape configured such that a smoking article rod for use with the attachable units 3, 203 can be inserted through the aligning apertures 306 while being guided by the inner edges of the aligning apertures 306. The receiving apertures 305 are dimensioned to receive attachable units 3, 203, and arranged such that the end of a respective attachable unit 3, 203 to which the smoking article rod is to be attached and received in a receiving aperture 305 faces a corresponding respective aligning aperture 306.

The body portion insert 304 includes an insert panel 304*a* in which the receiving apertures 305 are formed, supporting members 304*b* at the sides thereof for supporting the insert panel 304*a* at a predetermined height above the second panel 303*b* of the outer container 303, and side panels 304*c*.

The body portion insert 304 comprises a gripping mechanism 307 to releasably hold an attachable unit 3, 203 within the receiving aperture 305. In the present example, the gripping mechanism 307 comprises a plurality of tabs 308 that depend from an edge of each receiving aperture 305 for engagement with an attachable unit 3, 203 received therein. In alternative examples, the gripping mechanism 307 can comprise a single tab for each receiving aperture 305, and/or other mechanisms such as an adhesive.

Each tab 308 is at least partially resiliently displaceable and accordingly resiliently deforms when an attachable unit is inserted into the receiving aperture 305 producing a biasing force on the attachable unit 3, 203. In the present example, the tabs 308 are formed from sheet material cut from the insert panel 304*a* in which the receiving apertures 305 are formed. The tabs 308 are formed from sheet material cut from within the periphery of the receiving apertures 305, with uncut connecting regions maintaining the attachment of the tabs 308 to the edge of the retaining apertures 305.

For instance, four such tabs can be formed by cuts dividing the sheet material within each retaining aperture 305 into four portions. In alternative examples, the gripping mechanism 307 can be provided in other ways, for instance as an adhesive such as an adhesive patch which could, for instance, be provided on an inner surface of the second panel 303*b* of the outer container 303. Alternatively, adhesive could be provided around the edge of the receiving apertures 305 to form the gripping mechanism 307.

The first panel 303*a* can be provided with a resealable cover flap (not shown) that extends over each of the aligning apertures 306. The resealable cover flap can have a permanently tacky adhesive on an underside thereof, which forms a seal around the aligning apertures 306. The body portion 301 can, in this way, be sealed. This can help to prolong the shelf-life of the attachable units 3, 203 and after first opening of the packaging 300 keep unused attachable units fresh until required for use.

Figure 5A:
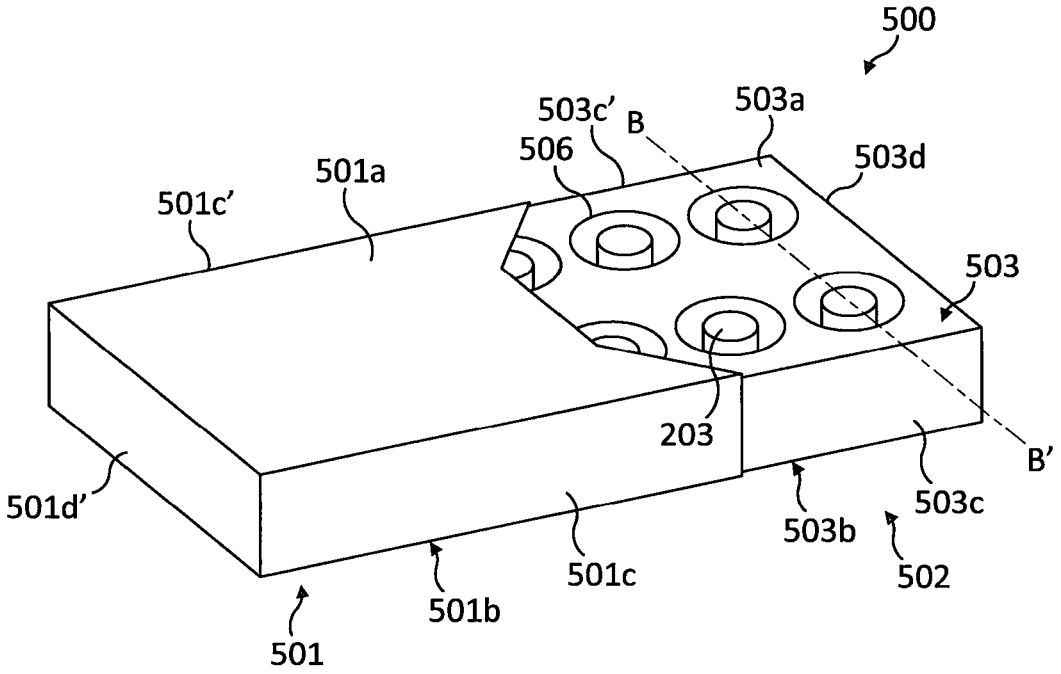
FIG. 5*a* is a perspective illustration of packaging for attachable units for smoking articles according to a second example.
Figure 5B:
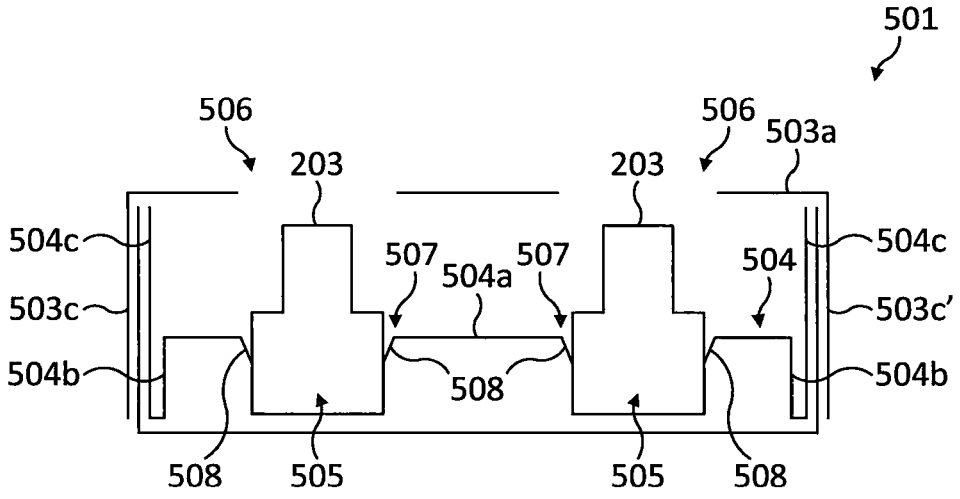
FIG. 5*b* is a cross sectional view of the packaging illustrated in FIG. 5*a*, through the line B-B' thereof.

Figure sa is a perspective illustration of packaging 500 for attachable units for smoking articles according to a second example. FIG. 5*b* is a cross sectional view of the packaging illustrated in FIG. 5*a*, through the line B-B' thereof.

The packaging 500 of the second example comprises a sleeve portion 501 and a tray 502 arranged to slide within the sleeve portion 501. The tray 502 comprises an outer portion 503 and a tray insert 504 received in the outer portion 503.

In the present example, the packaging 500 is substantially cuboid in shape. The sleeve portion 501 comprises a first panel 501*a*, a second panel 501*b*, first and second side panels 501*c*, 501*c*', a first end panel 501*d* (not shown in FIG. 5*a*) and a second end panel 501*d*', the side and end panels 501*c*, 501*c*', 501*d*, 501*d*' extending between the first and second panels 501*a*, 500*b*.

The tray outer portion 503 comprises a first panel 503*a*, a second panel 503*b*, first and second side panels 503*c*, 503*c*', and first and second end panels 503*d*, 503*d*' (the second end panel not shown in FIG. 5*a*), the side and end panels 503*c*, 503*c*', 503*d*, 503*d*' extending between the first and second panels 503*a*, 503*b*.

The tray insert 504 includes an insert panel 504*a* in which receiving apertures 505 are formed, supporting members 504*b* at the sides thereof for supporting the insert panel 504*a* at a predetermined height above the second panel 503*b* of the outer portion 503, and side panels 504*c*.

The tray insert 504 therefore includes receiving apertures 505 in which attachable units as described herein are receivable. In the present example, the receiving apertures 505 are illustrated having the attachable units 203 of the second attachable unit example received therein. A plurality of receiving apertures 505 are provided in the insert panel 504*a* of the tray insert 504 and correspond to the receiving apertures 305 described with reference to FIGS. 3 and 5.

The tray outer portion 503 also includes aligning apertures 506. In the present example, the aligning apertures 506 are provided in the first panel 503*a* of the outer portion 503. A plurality of aligning apertures 506 are provided in the first panel 503*a* of the tray outer portion 503 and correspond to the aligning apertures 306 described with reference to FIGS. 3 and 5. The aligning apertures 506 are each aligned with a respective receiving aperture 505 and spaced apart from the receiving aperture 505 so that, when an attachable unit 3, 203 is received in a receiving aperture 505 and a smoking article rod is inserted through a corresponding alignment aperture 506, the smoking article rod is aligned with the attachable unit 3, 203 prior to attachable of the attachable unit 3, 203 to the smoking article rod.

The tray 502 also comprises a gripping mechanism 507 to releasably hold an attachable unit 3, 203 within the receiving aperture 505 when an attachable unit 3, 203 is received in the receiving aperture 505, as described with reference to packaging example 1 and FIGS. 3 and 4. The gripping mechanism 507, in the present example, is formed by tabs 508 corresponding to the tabs 308 described with reference to packaging example 1 and FIGS. 3 and 4.

The first panel 503*a* can be provided with a resealable cover flap (not shown) that extends over each of the aligning apertures 506. The resealable cover flap can have a permanently tacky adhesive on an underside thereof, which forms a seal around the aligning apertures 506. The tray 502 can, in this way, be sealed. This can help to prolong the shelf-life of the attachable units 3, 203 and after first opening of the packaging 500 keep unused attachable units fresh until required for use.

Figure 6:
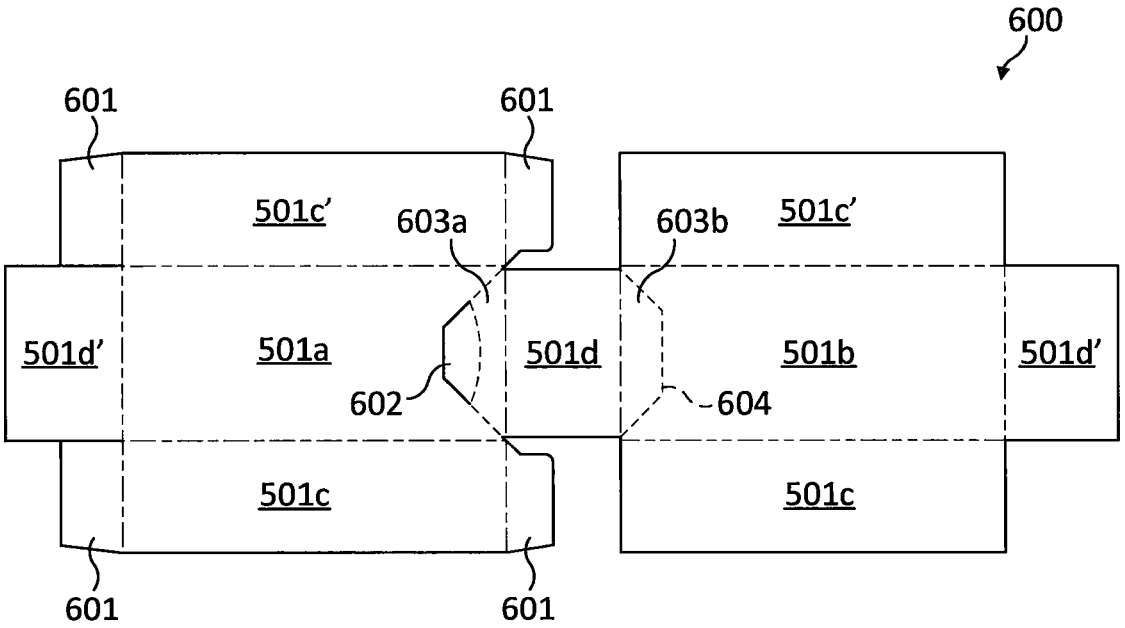
FIG. 6 illustrates a blank for forming an outer sleeve of the packaging of the second example.
Figure 7:
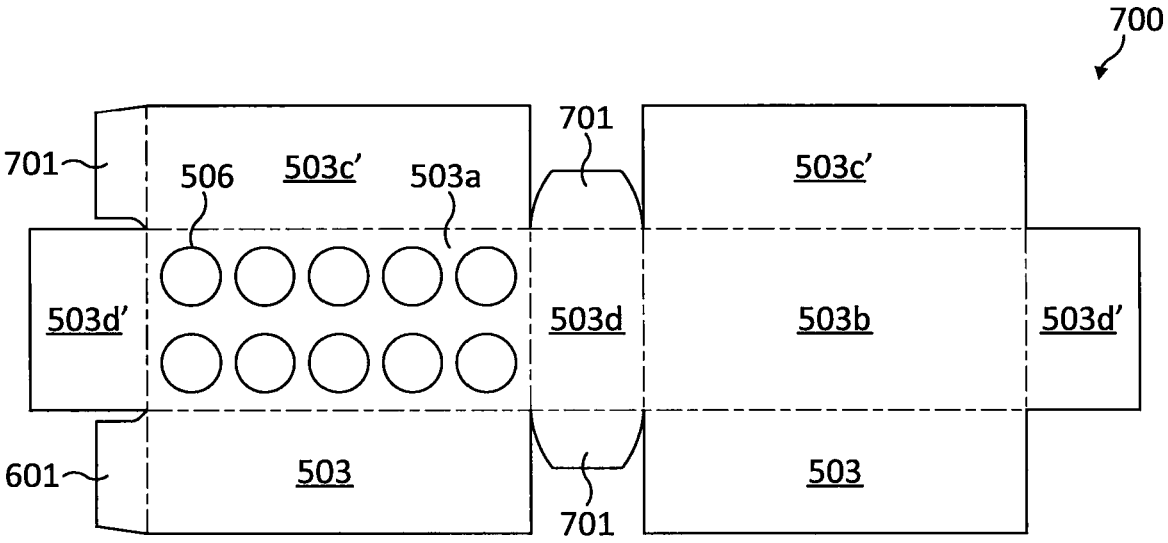
FIG. 7 illustrates a blank for forming an inner tray of the packaging of the second example.
Figure 8:
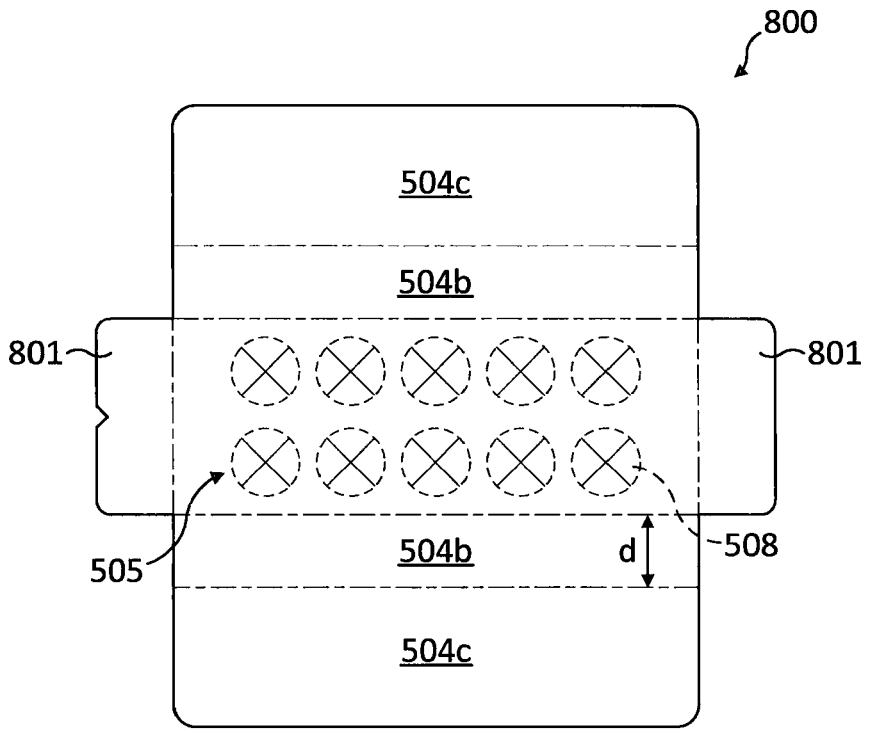
FIG. 8 illustrates a blank for forming an insert to be received in the inner tray of the packaging of the second example.

Blanks for forming the sleeve portion 501, the tray outer portion 503 and the tray insert 504 of the second packaging example are illustrated in FIGS. 6, 7 and 8 respectively.

Referring to FIG. 6, the sleeve portion blank 600 comprises a rectangular panel for forming the first panel 501*a* separated from a corresponding rectangular panel for forming the second panel 500*b*. Two rectangular panels form each of the first and second side panels 501*c*, 501*c*' of the sleeve portion 501, with these overlapping each other when the blank 600 is folded, and two rectangular panels form the second end panel 501*d*'. A single rectangular panel forms the first end panel 501*d*. Tabs 601 are provided with adhesive and attach the panels together when assembling the sleeve portion 501. When the blank 600 is folded to form the sleeve portion 501, the first panel 501*a* is folded over to lie parallel to the second panel 501*b* with first end panel 501*d* disposed perpendicularly in between. The first and second side panels 501*c*, 501*c*' and second end panel 501*d*' are formed by overlapping portions of the blank and adhesive can also be applied to these overlapping panels to adhere them together and hold the sleeve portion 501 in shape.

A cut out 602 and removable portion 603*a*, 603*b*, 501*d* is provided. The removable portion 603*a*, 603*b* comprises the first end panel 501*d* and a portion of the first and second panels 501*a*, 501*b* delineated by a perforated line of weakening 604. In both the first and second panels the line of weakening encloses a portion of the panel attached to the first end panel 501*b*. Therefore, when the blank is assembled to form the sleeve portion 501, the removable portion 603*a*, 603*b*, 501*d* can be separated along the line of weakening to remove the first end panel 501*d*, forming an opening in the sleeve portion 501 to enable the tray outer portion 502 to slide out of the sleeve portion 501. The portions of the first and second panels which are removed allow the user to grip the tray outer portion 502 to slide it from within the sleeve portion 501. The cut out 602 enables a user to pull the removable portion 603*a*, 603*b*, 501*d* away from the packaging.

A blank 700 for the tray outer portion 502 is shown in FIG. 7. The tray outer portion 502 is configured to fit within the sleeve portion 501 so that it loosely abuts inner surfaces of the sleeve portion 501 walls to slide easily out of the sleeve portion 501 when required.

The tray outer portion blank 700 comprises rectangular panels forming the first panel 503*a*, a second panel 503*b*, first and second side panels 503*c*, 503*c*', and first and second end panels 503*d*, 503*d*' of the tray outer portion 503. Tabs 701 are provided with adhesive attach the panels together when assembling the tray outer portion 503. The blank 700 is assembled in a similar way to the blank 600 forming the sleeve portion 501.

The first panel 503*a* of the tray outer portion 503 is provided with an array of aligning apertures 506. In the illustrated embodiment, a '2 by 5' array is shown, though any number of apertures may be provided depending on the size of the packaging and the number of attachable units which are to be stored.

A blank 800 for forming the tray insert 504 is shown in FIG. 8. The insert 504 is configured to fit within the tray outer portion 503.

The tray insert blank 800 comprises panels for forming the insert panel 504*a* in which the receiving apertures 505 are formed, supporting members 504*b* at the sides thereof for supporting the insert panel 504*a* at a predetermined height above the second panel 503*b* of the outer portion 503 when the packaging is assembled, and side panels 504*c*. In particular, the width 'd' of the rectangular portions forming the supporting members 504*b* determines the height of the insert panel 504*a*. To form the tray insert 504, the supporting member panels 504*b* are folded perpendicular to the insert panel 504*a*, and the side panels 504*c* are folded back onto the supporting member panels 504*b* to lie parallel to the supporting member panels 504*b*.

The tray insert 504 fits within the tray outer portion 503 such that the side panels 504*c* of the insert 504 abut the first and second side panels 503*c*, 503*c*' of the tray outer portion 503. Adhesive may be applied to the abutting surfaces for additional stability.

The insert panel 504*a* of the tray insert 504 is provided with an array of circular receiving apertures 505 aligned to the apertures 506 of the first panel 503*a* of the tray outer portion 503.

Figure 9:
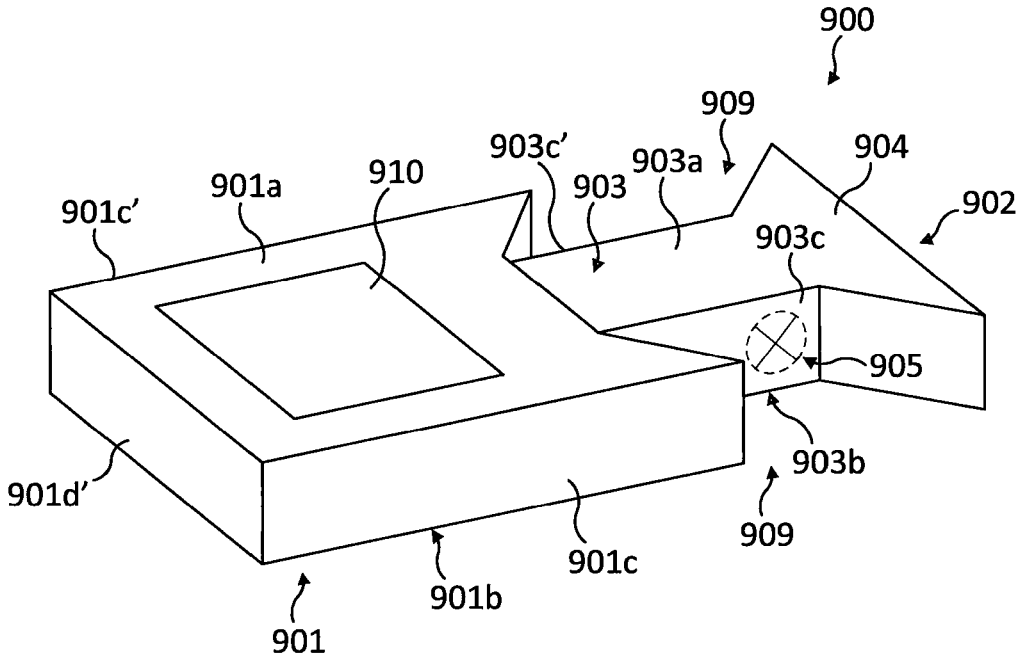
FIG. 9 is a perspective illustration of packaging for attachable units for smoking articles according to a third example.

FIG. 9 is a perspective illustration of packaging 900 for attachable units for smoking articles according to a third example.

The packaging 900 of the third example comprises a sleeve portion 901 and a tray 902 arranged to slide within the sleeve portion 901.

The sleeve portion 901 comprises a first panel 901*a*, a second panel 901*b*, first and second side panels 901*c*, 901*c*' a first end panel (not shown in FIG. 9) and a second end panel 901*d*', the side and end panels 901*c*, 901*c*', 901*d*, 901*d*' extending between the first and second panels 901*a*, 901*b*.

The tray 902 is arranged to slide within the sleeve portion 901 and comprises a main body portion 903 which is narrower than the width of the sleeve portion 901 across the width of the first and second panels 901*a*, 901*b*, and an end portion 904 which is substantially the width of the sleeve portion 901.

The main body portion 903 has a first panel 903*a*, a second panel 903*b*, and first and second side panels 903*c*, 903*c*'. The side panels 903*c*, 903*c*' are provided with an array of receiving apertures 905 as hereinbefore described, each receiving aperture 905 having a gripping mechanism as hereinbefore described for holding a respective one of the attachable units.

A space 909 is provided at each side of the main body portion 903 into which attachable units 3, 203 can project when held within the receiving apertures 905. An adhesive patch 910 is applied to an outer surface of the packaging to enable the packaging to be attached to an object or surface, for instance to a pack for tobacco industry products such as a cigarette pack. The adhesive patch 910 may comprise a protective cover sheet over the adhesive which is removable by a user to expose the adhesive when required.

Figure 10:
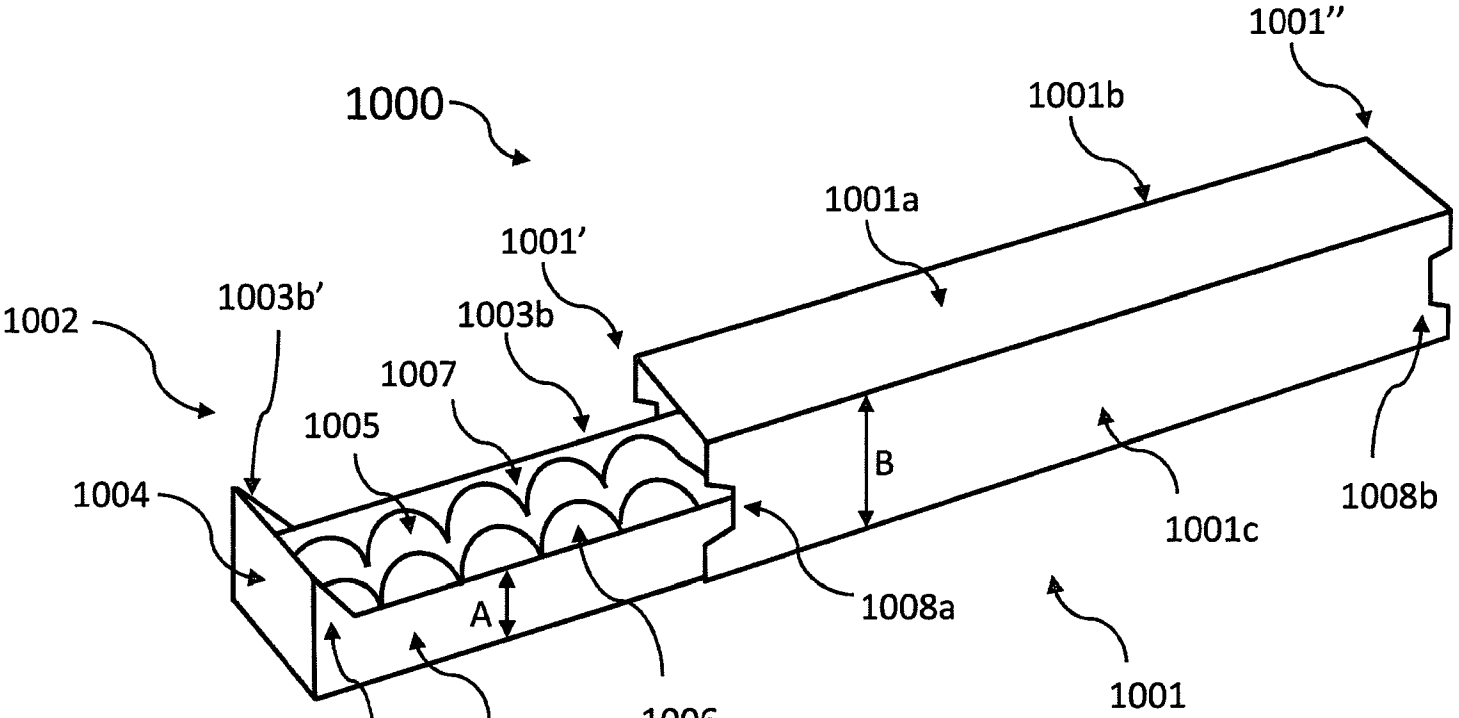
FIG. 10 is a perspective illustration of packaging for attachable units for smoking articles according to a fourth example.

FIG. 10 is a perspective illustration of packaging 1000 for attachable units for a smoking article according to a fourth example.

The packaging 1000 of the fourth example comprises a sleeve portion 1001 having a first end 1001' and a second end 1001", and a tray 1002 arranged to slide longitudinally within the sleeve portion 1001. The packaging 1000 is arranged so that the tray 1002 can be slid out of the first end 1001' or the second end 1001" of the sleeve portion 1001. The packaging 1000 comprises a means for preventing the tray 1002 from being completely removed from the sleeve portion 1001. Such means will be described in more detail below.

The sleeve portion 1001 comprises a first (or upper) panel 1001*a*, a second (or base) panel (not shown) and first and second side panels 1001*b*, 1001*c*.

The tray 1002 has a first side panel 1003*a* and a second side panel 1003*b*. At least a portion of each of the first and second side panels 1003*a*, 1003*b* has a height A which is less than a height B of the sleeve portion 1001, in the present case approximately 50% of the height B of the sleeve portion 1001. The height A can be between 20% and 80% of the height B of the sleeve portion 1001, or between 40% and 60% of the height B of the sleeve portion 1001.

The tray 1002 also has an end panel 1004 which has a height which is substantially the same as the height B of the sleeve portion 1001. The first side panel 1003*a* has a sloping end portion 1003*a*' sloping from the height of the end panel 1004 to the height A of the portion of the first side panels 1003*a*. The second side panel 1003*b* has a corresponding sloping end portion 1003*b*'.

The tray 1002 also has a base panel (not shown) and an upper panel 1007 extending at least partially across the upper side of the tray 1002.

The sleeve portion 1001 further comprises first and second cutouts 1008*a*, 1008*b* formed in either end of the second side panel 1001*c*, respectively. Corresponding cutouts (not shown) are formed in the first side panel 1001*b*. The cutouts allow the user to grip the first and second side panels 1003*a*, 1003*b* of the tray 1002 to slide the tray 1002 out from inside the sleeve portion 1001, when the tray 1002 is fully inserted in the sleeve portion 1001.

The tray 1002 comprises at least one receptacle or receiver, in the present example receiving aperture 1005, and at least one gripping mechanism to releasably hold an attachable unit 3, 203 within the at least one receiving aperture 1005. In the present example, the upper panel 2007 extends only a portion of the way across the upper side of the tray 1002 from second side panel 1003*b* towards first side panel 1003*a* and the at least one receiving aperture 1005 is formed as a gap between the upper panel 1007 and a surface at the opposite side of the tray 1002. In the present example, one or more recesses or cut-outs are formed in the upper panel 1007 of the tray 1002, these having a shape corresponding to at least a portion of an attachable unit 3, 203 to be received in the aperture 1005. The apertures 1005 are defined between each recess or cut-out and a corresponding opposite side of the tray 1005. In the present example, the opposite side of the tray 1005 comprises one or more tabs 1006, each corresponding to a recess or cut-outs, although the tabs 1006 can be omitted. In the present example, the tray 1002 comprises ten receiving apertures 1005.

In the present example, a gripping mechanism is provided for each receiving aperture 1005 and comprises a tab 1006 that extends from an edge of the first side panel 1003*a* for engagement with an attachable unit 3, 203 received in the receiving aperture. In the present example, the tabs 1006 are semi-circular in shape. In alternative examples, the gripping mechanism may comprise tabs with different shapes, e.g. squares or triangles. In further alternative examples, the gripping mechanism may comprise other mechanisms such as an adhesive.

Each tab 1006 is at least partially resiliently displaceable, and accordingly resiliently deforms when an attachable unit 3, 203 as described herein is inserted into a corresponding receiving aperture 1005, thus producing a biasing force on the attachable unit 3, 203.

The sleeve portion 1001 and the tray 1002 are configured so that when the tray 1002 is inserted in the sleeve portion 1001, there is a space provided above the receiving apertures 1005, into which attachable units 3, 203 can project when held within the receiving apertures 1005.

Figure 11:
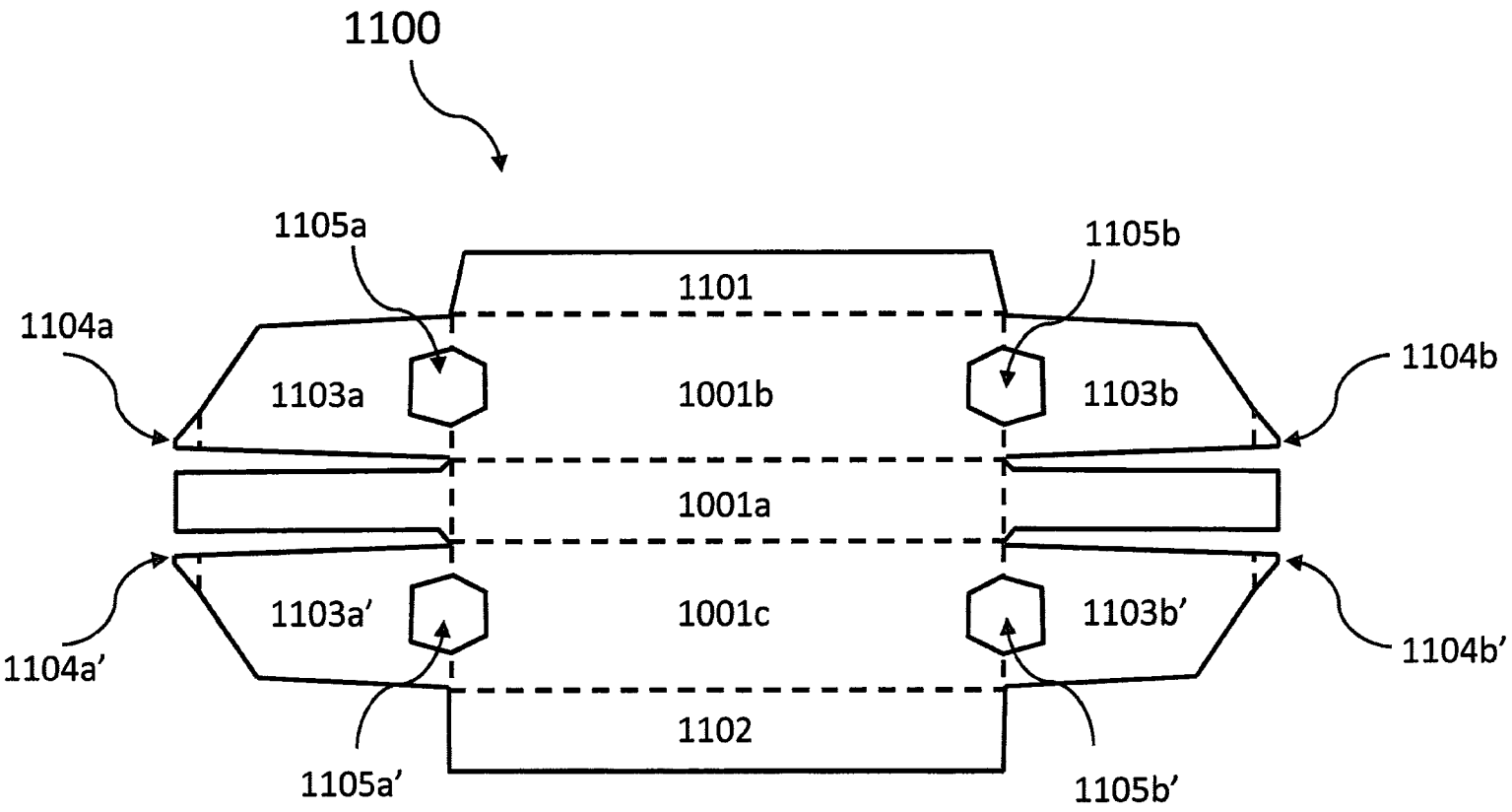
FIG. 11 illustrates a blank for forming a sleeve of the packaging of the fourth example.
Figure 12:
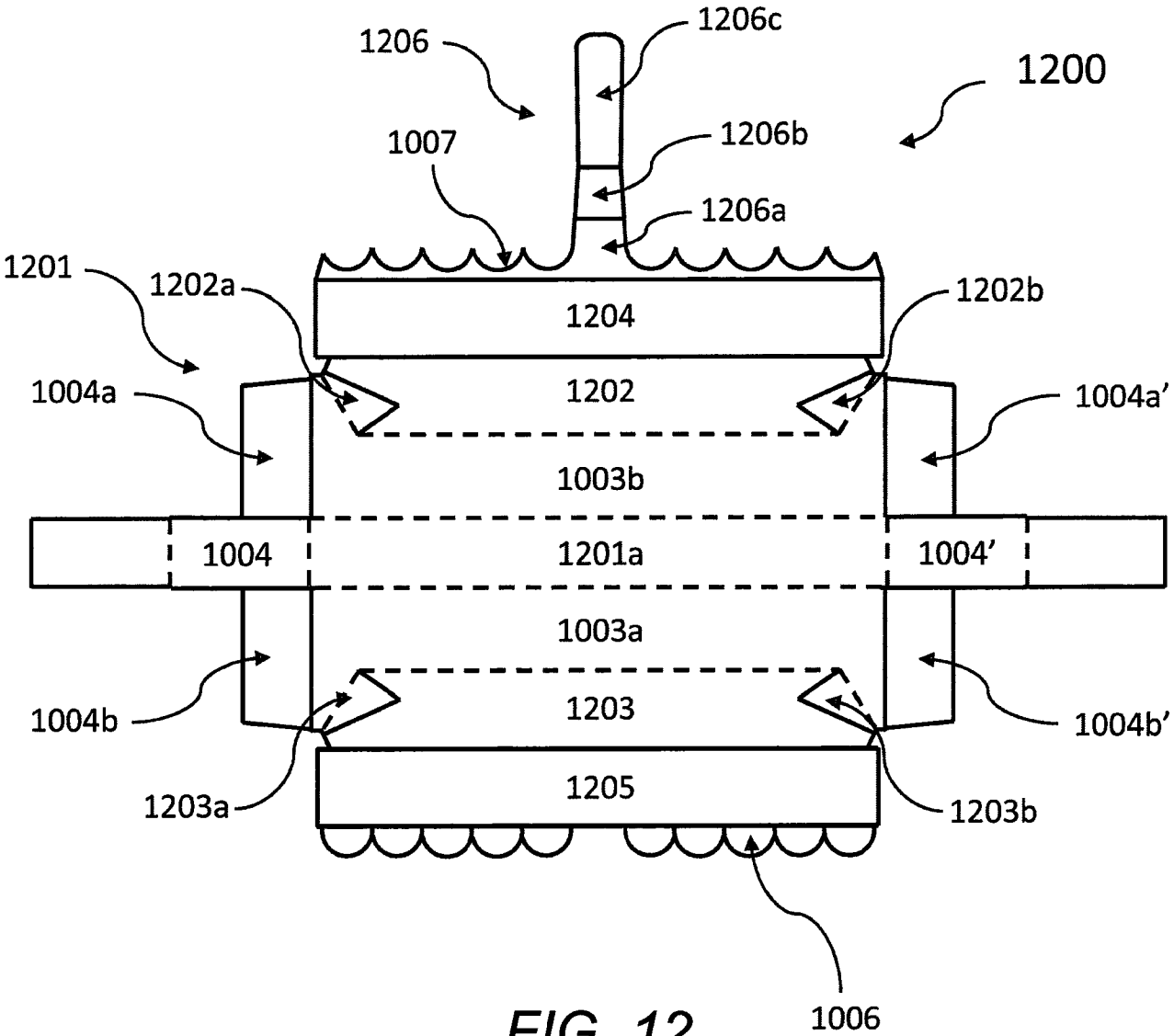
FIG. 12 illustrates a blank for forming a tray of the packaging of the fourth example.

Blanks for forming the sleeve portion 1001 and the tray 1002 of the fourth packaging example are illustrated in FIGS. 11 and 12 respectively.

Referring to FIG. 11, the sleeve portion blank 1100 comprises a rectangular panel for forming the first panel 1001*a* of the sleeve portion 1001. Two substantially rectangular panels disposed on either side of the rectangular panel form the first and second side panels 1001*b*, 1001*c* of the sleeve portion 1001, respectively.

When the blank 1100 is folded to form the sleeve portion 1001, the first and second side panels 1001*b*, 1001*c* are folded towards each other to lie parallel to one another. The first panel 1001*a* is disposed perpendicularly in between the first and second side panels 1001*b*, 1001*c*.

The second panel is formed by overlapping portions 1101, 1102 of the blank 1100, which are disposed perpendicularly to the first and second side panels 1001*b*, 1001*c* when the sleeve portion 1001 is formed.

Two pairs of panels 1103*a*, 1103*a*' and 1103*b*, 1103*b*' are provided on the blank 1100. The panels 1103*a*, 1103*b* extend from either side of the panel used to form the first side panel 1001*b*, while the panels 1103*a*', 1103*b*' extend from either side of the panel used to form the second side panel 1001*c*.

The two pairs of panels 1103*a*, 1103*a*' and 1103*b*, 1103*b*' are folded towards each other when forming the sleeve portion 1001 and are disposed inside the sleeve portion 1001, substantially parallel to the first and second side panels 1001*b*, 1001*c*. Each of the panels 1103*a*, 1103*a*', 1103*b*, 1103*b*' has a respective tab 1104*a*, 1104*a*', 1104*b*, 1104*b*'. Upon forming the sleeve portion 1001, the tabs 1104*a*, 1104*a*', 1104*b*, 1104*b*' are folded inwardly so as to lie substantially parallel to the respective panels 1103*a*, 1103*a*', 1103*b*, 1103*b*'.

The shapes of the tabs 1104*a*, 1104*a*', 1104*b*, 1104*b*' are configured so as to engage with the respective ends of the sleeve portion. For example, tab 1104*a* engages with end 1003*a*' in the assembled packaging 1000. This arrangement prevents the tray 1002 from sliding out from the sleeve portion 1001 further than a predetermined amount, which prevents the tray 1002 and sleeve portion 1001 from being unintentionally separated by the user.

In the present example, the panels 1103*a*, 1103*a*', 1103*b*, 1103*b*' and tabs 1104*a*, 1104*a*', 1104*b*, 1104*b*' are configured so that a maximum of 40% of the length of the tray 1002 can be slid out of the sleeve portion 1001. This arrangement also helps to maintain the strength of the packaging by maintaining at least a 60% overlap of the sleeve portion 1001 and tray 1002 at all times.

Although in the present example the packaging 1000 is configured so that a maximum of 40% of the length of the tray 1002 can be slid out of the sleeve portion 1001, alternative configurations may be used, i.e. so that a different length of the tray 1002 protrudes from the sleeve portion 1001 as a maximum length. For example, the packaging 1000 may be configured so that between 30% and 60% of the length of the tray 1002 can be slid out of the sleeve portion 1001.

In the present example, tabs are used to form a means for preventing the tray 1002 from being completely removed from the sleeve portion 1001. In other examples, alternative arrangements such as glue dots or embossed/raised areas of sheet material may be used, which produce narrower portions within the sleeve portion 1001 and therefore engage with the tray 1002 to limit movement of the tray 1002 within the sleeve portion 1001.

Cutouts 1105*a*, 1105*a*' and 1105*b*, 1105*b*' are formed in the blank 1100. The cutouts 1105*a* and 1105*b* form the cutouts 1108*a* and 1108*b* respectively when the blank is assembled into the sleeve portion 1001.

Referring to FIG. 12, the tray blank 1200 comprises a substantially rectangular central section 1201 for forming the first and second side panels 1003*a*, 1003*b*. The central section 1201 comprises a panel 1201*a* for forming the base panel of the tray 1002. The panel 1201*a* is disposed between the first and second side panels 1003*a*, 1003*b*. The central section also comprises two panels 1202, 1203 adjacent to the first and second side panels 1003*b* and 1003*a* respectively.

Tabs 1202*a* and 1202*b* are formed on the blank 1200 on either side of the panel 1202, and tabs 1203*a* and 1203*b* are formed on the blank 1200 on either side of the panel 1203. When forming the tray 1002, the tabs 1202*a* and 1202*b* are folded inwardly to overlap with the second side panel 1003*b*, and the tabs 1203*a* and 1203*b* are folded inwardly to overlap with the first side panel 1003*a*, in order to strengthen the end portions of the tray 1002.

Two tabs extend from either side of the panel 1201*a* of the central section 1201 and are used to form the end panel 1004 and a second end panel 1004'. Tabs 1004*a*, 1004*b* extend from the central section 1201 on either side of the tab used to form the end panel 1004, while tabs 1004*a*', 1004*b*' extend from the central section 1201 on either side of the tab used to form the end panel 1004'. The tabs 1004*a*, 1004*b* and 1004*a*', 1004*b*' are folded inwardly when forming the tray 1002, so that the tabs 1004*a*, 1004*b* overlap with the end panel 1004 and the tabs 1004*a*', 1004*b*' overlap with the end panel 1004'. This arrangement helps to strengthen the end panels 1004, 1004' in the assembled tray 1002.

The tray blank 1200 further comprises two rectangular sections 1204, 1205 disposed on either side of the central section 1201, adjacent to the panels 1202 and 1203 respectively. In the assembled tray 1002, panel 1203 and section 1205 overlap with the first side panel 1003*a*, and panel 1202 and section 1204 overlap with the second side panel 1003*b*, so as to strengthen the first and second side panels 1003*a*, 1003*b*.

Figure 13:
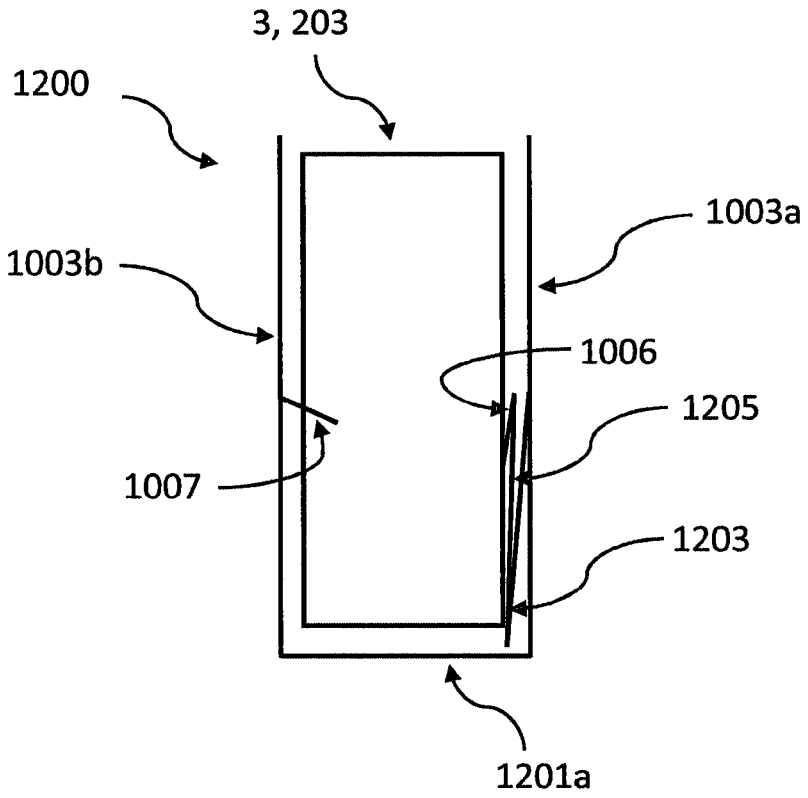
FIG. 13 is a cross-sectional illustration of a tray of the packaging of the fourth example and an attachable unit within the tray.

The receiving apertures 1005 of the assembled tray 1002 are defined by recesses formed in a panel 1007 adjacent to section 1204, while the tabs 1006 are formed adjacent to section 1205. The size and shape of the upper panel 1007 can be configured so that, when one or more attachable units 3, 203 are received in the tray 1002, the panel 1007 is disposed parallel to the base panel of the tray 1002. Alternatively, the size of the upper panel 1007 can be configured so that, when one or more attachable units 3, 203 are received in the tray 1002, the upper panel 1007 extends downwardly in the tray 1002 as it extends away from the second side panel 1003*b*. This is illustrated in FIG. 13. In other words, the panel 1007 is disposed nonparallel to the base panel of the tray 1002 and, in the present example, such that it extends away from the second side panel 1003*b* of the tray 1002 towards the base panel 1201*a* of the tray 1002 as well as towards the first side panel 1003*a* of the tray 1002. This arrangement can help to restrict the upper panel 1007 from rising and therefore helps to hold the panel 1007 in position when an attachable unit 3, 203 is removed from the tray 1002 in use.

In the present example, a central protrusion 1206 is disposed adjacent to the rectangular section 1204. The central protrusion 1206 is optional, and may be omitted from the tray blank 1200. In the present example, the blank 1200 is configured so that equal numbers of receiving apertures 1005 are formed on either side of the central protrusion 1206. That is, in the present example, five receiving apertures 1005 are formed on each side of the central protrusion 1206.

In the present example, the central protrusion 1206 comprises three parts 1206*a*, 1206*b*, 1206*c*. When assembling the tray 1002, the three parts 1206*a*, 1206*b*, 1206*c* of the central protrusion 1206 are folded so that the central protrusion 1206 forms a guide member (not shown) that extends above the first and second side panels 1003*a*, 1003*b* in the assembled tray 1002.

The guide member is configured to provide a reactive force against the sleeve portion 1001 to keep the base panel of the tray 1002 substantially parallel to the upper panel 1001*a* of the sleeve portion 1001 as the tray 1002 is moved relative to the sleeve portion 1001. Thus, when the packaging 1000 is in a fully open position (i.e. 40% of the length of the tray 1002 is slid out of the sleeve portion 1001 in the present example), the guide member prevents the tray 1002 from being lifted up relative to the sleeve portion 1001. In the present example, the guide member is configured to provide a reactive force against the upper panel 1001*a* of the sleeve portion 1001. However, the guide member may be configured to engage with a different part of the sleeve portion 1001.

In some arrangements, the panels 1202, 1203 may be secured to the first and second side panels 1003*b*, 1003*a* respectively when assembling the tray 1002. This may be achieved, for example, by means of an adhesive.

A cross-section of the tray 1002 and an attachable unit 3, 203 is shown in FIG. 13. In this arrangement, the panel 1203 is not secured to the first side panel 1003*a*, and protrudes inwardly within the tray 1002.

In the present example, the gripping mechanism comprises the panel 1203. The panel 1203 is at least partially resiliently displaceable, and accordingly resiliently deforms when an attachable unit 3, 203 as described herein is inserted into a corresponding receiving aperture 1005, thus producing a biasing force on the attachable unit 3, 203. This arrangement allows the attachable units 3, 203 to be held more securely within the tray 1002. In the present example, the biasing force provided by the panel 1203 is in addition to the biasing force provided by the tabs 1006. Optionally, the tabs 1006 may be omitted from the tray 1002, such that the gripping mechanism comprises only the panel 1203.

In order to address various issues and advance the art, the entirety of this disclosure shows by way of illustration various embodiments in which the claimed invention(s) may be practiced and provide for superior packaging for attachable units for smoking articles. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. Packaging for an attachable unit for a smoking article comprising:

a receptacle or receiver in which the attachable unit is receivable;

a gripping mechanism to releasably hold the attachable unit within the receptacle or receiver when the attachable unit is received in the receptacle or receiver;

a sleeve portion comprising a base panel and an upper panel; and a tray slidable within the sleeve portion, wherein the tray comprises the receptacle or receiver; and a plurality of side panels, and wherein the tray further comprises:

a base panel adjacent to the base panel of the sleeve portion; and a guide member configured to provide a reactive force against the upper panel of the sleeve portion to keep the base panel of the tray substantially parallel to the upper panel of the sleeve portion as the tray is slid within the sleeve portion, and wherein at least a portion of at least one of the plurality of side panels has a height which is between 20% and 80% of a height of a side panel of the sleeve portion.

2. Packaging according to claim 1, wherein the receptacle or receiver comprises a receiving aperture which is at least partially defined by a recess or cut-out formed in an upper panel of the tray.

3. Packaging according to claim 2, wherein the upper panel of the tray is arranged to be disposed parallel to the base panel of the tray when the attachable unit is received in the receptacle or receiver.

4. Packaging according to claim 2, wherein the upper panel of the tray is arranged to be disposed nonparallel to the base panel of the tray and the attachable unit is received in the receptacle or receiver.

5. Packaging according to claim 1, wherein the receptacle or receiver comprises a receiving aperture and the gripping mechanism comprises a tab that depends from an edge of the receiving aperture for engagement with an attachable unit received therein.

6. Packaging according to claim 5, wherein the tab is at least partially resiliently displaceable.

7. Packaging according to claim 5, wherein the tab is formed from material forming a panel in which the receptacle is formed.

8. Packaging according to claim 5, wherein the tab is formed from material within the periphery of the receiving aperture.

9. Packaging according to claim 5, comprising between one and six tabs for each receiving aperture.

10. Packaging according to claim 9, comprising four tabs for each receiving aperture.

11. Packaging according to claim 1, wherein the gripping mechanism comprises an adhesive.

12. Packaging according to claim 1, comprising an attachable unit for a smoking article received by the or each receiver, the attachable unit to be attached to a smoking article rod by a user to modify an aerosol generated by the smoking article rod.

13. Packaging according to claim 1, further comprising a gripping mechanism to releasably hold the attachable unit within the receptacle or receiver when the attachable unit is received in the receptacle or receiver.

14. Packaging according to claim 1, wherein the height of said portion of at least one of the plurality of side panels is between 40% and 60% of the height of the sleeve portion.

15. Packaging according to claim 1, wherein the sleeve portion comprises a first end and a second end, and the tray can be slid out of either of the first end or the second end.

16. An arrangement of one or more blanks for forming packaging according to claim 1.

17. A kit comprising packaging according to claim 1, and a plurality of smoking article rods.

* * * * *